United States Patent [19]

Kinsel

[11] 4,308,828

[45] Jan. 5, 1982

[54] ADD-ON HEAVY-DUTY VALVE-CLOSING DEVICE FOR HIGH-PERFORMANCE RACING ENGINES

[76] Inventor: David L. Kinsel, 3350 S. Sixth St., Springfield, Ill. 62703

[21] Appl. No.: 130,212

[22] Filed: Mar. 14, 1980

[51] Int. Cl.[3] ..... F01L 1/30

[52] U.S. Cl. ..... 123/90.39; 123/90.38; 123/90.45; 123/90.65; 123/90.24

[58] Field of Search ..... 123/90.24, 90.39, 90.41, 123/90.45, 90.65, 90.38, 195 R, 195 C, 198 E; 74/559

[56] References Cited

U.S. PATENT DOCUMENTS

| | | | |
|---|---|---|---|
| 1,395,851 | 11/1921 | McLean | 123/90.39 |
| 1,902,696 | 3/1933 | Elmer | 123/90.39 |
| 2,041,539 | 5/1936 | Gaultier | 123/90.39 |
| 2,398,206 | 4/1946 | Chilton | 123/90.39 |
| 2,827,888 | 3/1958 | Chadwell | 123/90.39 |

*Primary Examiner*—Craig R. Feinberg
*Assistant Examiner*—W. R. Wolfe
*Attorney, Agent, or Firm*—Ralph F. Staubly

[57] ABSTRACT

To greatly increase the size and thus the strength and life of the valve-closing spring of a high-performance (e.g. automobile-racing) engine, a rocker arm is employed to couple the much larger remotely located spring to the valve stem, from which was removed the smaller short-lived spring for which the much larger spring is substituted. The rocker arm and the substituted large spring are mounted on a base plate attachable to the engine-head assembly, and a cover shell is made removable for access to the parts, which include an adjustable-length spring-pressure-adjusting hold-down device.

1 Claim, 3 Drawing Figures

FIG. 2
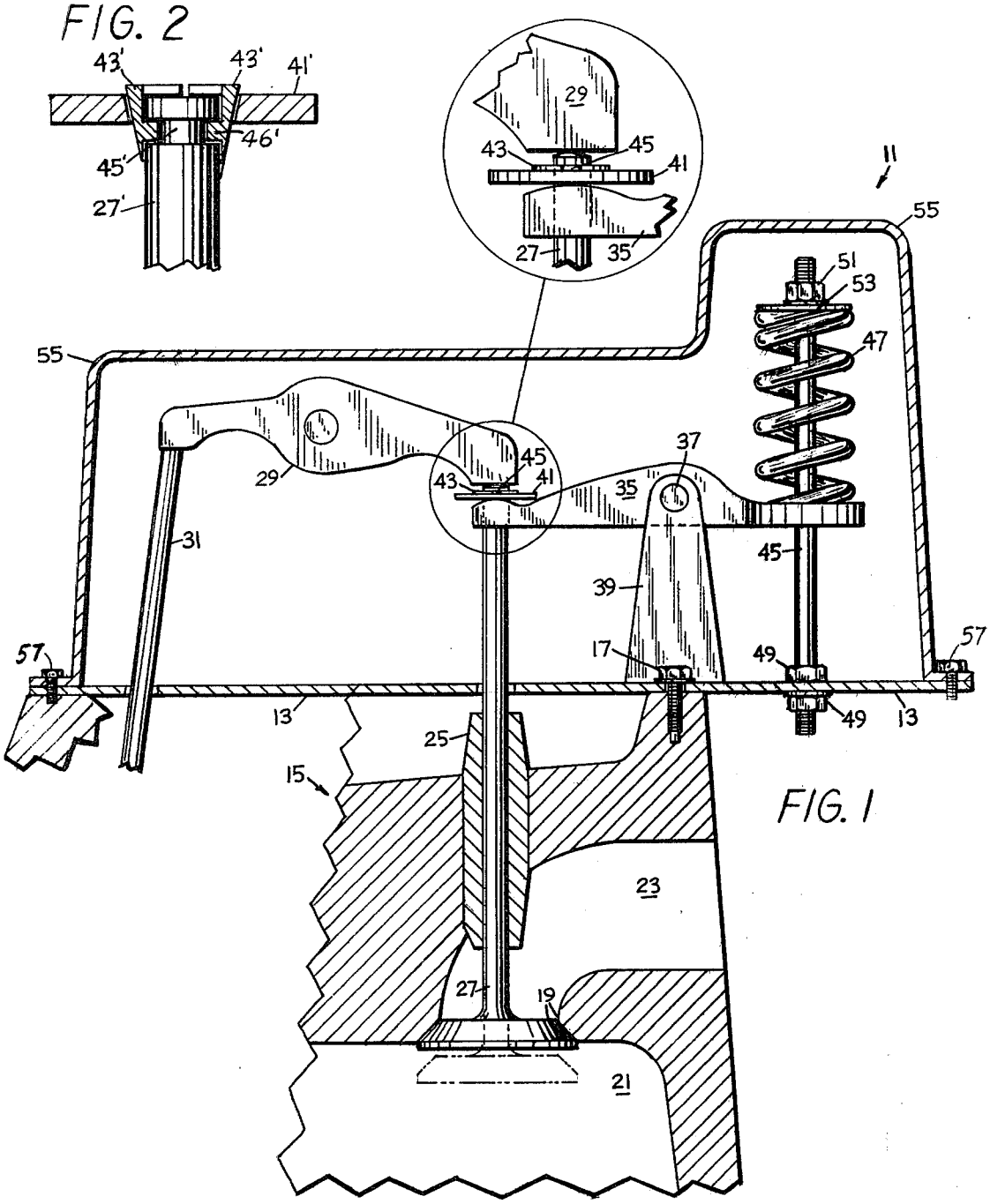
FIG. 1
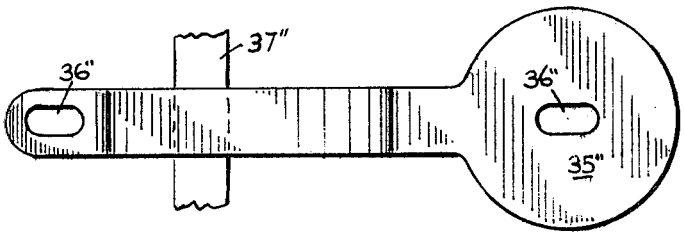
FIG. 3

ADD-ON HEAVY-DUTY VALVE-CLOSING DEVICE FOR HIGH-PERFORMANCE RACING ENGINES

BACKGROUND AND OBJECTS OF THE INVENTION

In stock-racing engines the life of valve-closing springs has been very short due to their being limited in size by the length and geometry of the valve and rocker-arm system. Attempts at solving the problem by varying the compositions of the spring alloys have been only slightly successful.

It is accordingly the principal object of the present invention to provide an add-on device which permits the use of a much larger (and thus stronger) spring by employing therein a rocker-arm coupled to a spring that can be much larger by its being positioned remotely from the limited space allowed for the omitted (replaced) spring. Other objects and advantages will become apparent as the following detailed description proceeds.

BRIEF DESCRIPTIONS OF THE DRAWING FIGURES

FIG. 1 is a fragmentary elevational view partly in transverse cross-section of a preferred embodiment of the invention.

FIG. 2 is a fragmentary enlarged elevational view in vertical axial cross-section of a modified form of connector joining the valve stem to the rocker-arm-engaging disk.

FIG. 3 is an enlarged plan view of the rocker arm of the add-on device.

DETAILED DESCRIPTION

With reference now to the drawing, the numeral 11 generally designates the add-on device embodying the invention. The device 11 is mounted on a base plate 13 which is fixed to the top surface of the engine head-assembly 15 as by several machine screws 17 (or existing head bolts).

The co-operating engine parts are the valve 19 between the cylinder chamber 21 and the gas-flow port 23, a guide 25 for the valve stem 27, and a rocker arm 29 for transmitting the valve-opening force from the conventional cam-operated push rod 31 to the valve stem 27.

The add-on device 11 comprises a rocker arm 35 mounted on a pintle 37 which is supported by a rocker stand 39 fixed to the base plate 13 by any suitable means (not shown). The left end of the rocker arm 35 is apertured to straddle the valve stem 27 and to engage under the disk 41. The disk 41 is clamped between the rocker arm 35 and a radially split washer 43 (of known construction) engaged in the usual circular groove 45 near the upper end of the valve stem 27.

The right end of the rocker arm 35 is apertured or split to loosely embrace a rod 45 about which is positioned a spring 47 which is larger and stronger than the spring (not shown) which it replaces. (The not-shown replaced spring normally would surround the upper reach of the valve stem 27.)

The rod 45 is fixed to the base plate 13 in any suitable manner, as by nuts 49 on its lower threaded end. The upper end of the rod 45 is also threaded to receive a hold-down nut 51 for adjustably pressing a washer 53 against the upper end of the spring 47. The device 11 and its initially present co-operating engine parts are protected by a cover shell 55 fixed to the engine block as by machine screws 57.

FIG. 2 discloses a modified form of connector between the valve stem 27' and the disk 41'. It comprises a bilaterally symmetrical split pair of conically tapered elements 43' having semicircular tongues entering the groove 45'.

FIG. 3 shows the pintle 37'' moved to the left of its position shown in FIG. 1 to increase the spring force exerted through the modified leverage.

In FIGS. 2 and 3, parts corresponding to like parts in FIG. 1 are designated by primed and double-primed numerals which are not primed in FIG. 1.

The invention having been discribed, what is claimed is:

1. In an internal-combustion engine having: a metal block with a horizontal top surface, a combustion chamber formed in said block, a gas-flow port formed in the top wall of said chamber, a horizontally disposed annular valve seat constituting a rim of said gas-flow port, a valving disk movable to and from closing and opening positions relative to said seat and said port, a vertically disposed valve stem fixed co-axially to said disk and extending upwardly above said top surface of said metal block, a conventional rocker-arm-medially pivotally mounted to and above the top surface of said metal block, a conventional cam-shaft-operable push-rod liftingly engageable under one end of said rocker arm, the other end of said rocker arm being positioned for depressingly engaging the upper end of said valve stem; the improvement in said internal combustion engine, comprising: a rigid base plate overlying and fixed to the top surface of said metal block and having a portion extending horizontally well beyond an edge of said top surface, an upright rocker-arm-supporting stand fixed to said base plate closely adjacent said edge of said top surface, a second rocker arm pivotally mounted on the upper end of said rocker-arm-supporting stand, means liftingly coupling the upper end of said valve stem to one end of said second rocker arm, a very strong and large compression coil spring bearing downwardly against the other end of said second rocker arm which end and coil spring are located horizontally well beyond said edge of said metal block, and adjustable pull-down means for variably compressing said coil spring.

* * * * *